US010712135B1

(12) United States Patent
Bullock

(10) Patent No.: US 10,712,135 B1
(45) Date of Patent: Jul. 14, 2020

(54) NON-PROJECTILE CARTRIDGE FOR FIREARM

(71) Applicant: Jesse Bullock, Las Vegas, NV (US)

(72) Inventor: Jesse Bullock, Las Vegas, NV (US)

( * ) Notice: Subject to any disclaimer, the term of this patent is extended or adjusted under 35 U.S.C. 154(b) by 0 days.

(21) Appl. No.: 16/579,507

(22) Filed: Sep. 23, 2019

(51) Int. Cl.
*F42B 8/08* (2006.01)
*F41A 33/06* (2006.01)

(52) U.S. Cl.
CPC ..... *F42B 8/08* (2013.01); *F41A 33/06* (2013.01)

(58) Field of Classification Search
CPC ..... F42B 8/08; F42B 8/02; F41A 33/06
USPC ..... 102/430, 439, 444, 504, 442, 529
See application file for complete search history.

(56) References Cited

U.S. PATENT DOCUMENTS 3,027,674 A * 4/1962 Mahan ..... F41A 17/44 42/66
3,208,176 A * 9/1965 Giles ..... F41A 17/44 42/66
3,233,353 A * 2/1966 Lahr ..... F42B 8/06 42/54
3,369,534 A * 2/1968 Crosman ..... F42B 8/02 124/26
3,762,089 A * 10/1973 Meyer, Jr. ..... F41A 17/20 42/70.08
4,092,794 A * 6/1978 Moren ..... A63H 5/04 42/70.11
5,052,142 A * 10/1991 Mikus ..... F41A 17/44 42/70.11
D349,323 S * 8/1994 Howard ..... D22/108
5,491,918 A * 2/1996 Elmstedt ..... F41A 17/44 42/70.11
5,950,344 A * 9/1999 Ross ..... F41A 17/44 42/70.11
6,041,536 A * 3/2000 Samuels ..... F41A 17/44 42/70.11
6,408,556 B1 * 6/2002 Achee ..... F41A 17/44 42/70.11
6,427,600 B2 * 8/2002 Saxby ..... F42B 8/04 102/444
6,895,707 B2 * 5/2005 Young ..... F41A 17/44 42/70.11
2004/0211103 A1 * 10/2004 Aske ..... F41A 17/44 42/70.11
2012/0233900 A1 * 9/2012 Notomi ..... F41A 33/04 42/54

* cited by examiner

*Primary Examiner* — John Cooper
(74) *Attorney, Agent, or Firm* — Patent Ingenuity, P.C.; Samuel K. Simpson

(57) ABSTRACT

A non-projectile cartridge apparatus has a cartridge casing having a receiver positioned therein. Further, the non-projectile cartridge has a simulated primer positioned at the bottom of the cartridge casing. Moreover, the non-projectile cartridge has a rim positioned around at least a portion of a circumference of the cartridge casing. The rim is gripped by an extractor of a firearm after a firing pin of the firearm strikes the simulated primer. Additionally, the non-projectile member has a connector. The non-projectile member is in a closed position within the cartridge casing during a connection between the connector and the receiver. Further, the non-projectile member is in an open position during a disconnection between the connector and the receiver. The disconnection occurs as a result of the firing pin striking the simulated primer.

20 Claims, 6 Drawing Sheets

NON-PROJECTILE CARTRIDGE FOR FIREARM

BACKGROUND

1. Field

This disclosure generally relates to firearms. More particularly, the disclosure relates to cartridges for firearms.

2. General Background

Use of a firearm (pistol, rifle, etc.) is potentially dangerous, and often requires extensive practice by a firearm user to safely use the firearm. One example of such practice is target practice: a user shooting a firearm with live ammunition with the intent of a projectile hitting a target in a controlled practice environment (e.g., a shooting range). Yet, for an active firearm user, especially one that uses a semi-automatic firearm, target practice is simply not enough.

In addition to target practice, firearm handling practice is essential to an active firearm user being able to safely use a firearm. A variety of tasks (e.g., drawing a firearm from a holster, lining up the sights on the firearm, shooting SNAP-CAPs to get the feel of possible jams and how to respond appropriately, etc.) are often involved in firearm handling practice. For safety purposes, such firearm handling practice is often performed with SNAP-CAPs, away from a live firearm environment. For example, a firearm user may want to practice firearm handling in his or her own home.

Yet, unlike target practice, firearm handling practice typically lacks a sense of realism. For example, when shooting SNAP-CAPs, a firearm will typically not cause the slide to recoil backwards. In other words, when performing firearm practice with SNAP-CAPs, the firearm user typically does not feel the "kick" of a real firearm recoil that he or she would typically feel when firing live rounds—instead, the firearm user may hear a small click without feeling much reverberation.

Further, the firearm mechanics themselves are different with respect to a firearm firing a live cartridge rather than a SNAP-CAP. For instance, at the completion of firing all of the live cartridges in a magazine, the slide of a pistol will typically be recoiled, which necessitates the firearm user manually sliding the slide back into place when inserting a new magazine. However, at the completion of firing all of the SNAP-CAPs in a magazine, the slide of the pistol will typically not be recoiled. As a result, the firearm user may easily develop different muscle memory when practicing with SNAP-CAPs than when practicing with live cartridges; such different muscle memory can lead to the firearm user developing a habit that is not conducive to safe firearm handling practices.

Accordingly, current firearm configurations are inadequate for allowing a firearm user to practice firearm handling safely.

SUMMARY

In one embodiment, a non-projectile cartridge apparatus has a cartridge casing having a receiver positioned therein. Further, the non-projectile cartridge has a simulated primer positioned at the bottom of the cartridge casing. Moreover, the non-projectile cartridge has a rim positioned around at least a portion of a circumference of the cartridge casing. The rim is gripped by an extractor of a firearm after a firing pin of the firearm strikes the simulated primer.

Additionally, the non-projectile member has a connector. The non-projectile member is in a closed position within the cartridge casing during a connection between the connector and the receiver. Further, the non-projectile member is in an open position during a disconnection between the connector and the receiver. The disconnection occurs as a result of the firing pin striking the simulated primer. A top of the non-projectile member travels a distance within a predetermined range from a top of the cartridge casing in the open position without a bottom of the non-projectile member exiting the cartridge casing.

In another embodiment, the non-projectile cartridge apparatus has a plunger positioned within the receiver. The plunger is moveable in a direction toward a top of the receiver. Further, the non-projectile cartridge apparatus has one or more connector indentations positioned within the connector, and one or more receiver indentations positioned within the receiver. Finally, the non-projectile cartridge apparatus has one or more balls configured in the closed position to at least partially fill the one or more connector indentations, at least partially fill the one or more receiver indentations, and to be in contact with a least a portion of a periphery of the plunger in the closed position. The one or more balls exit the one or more connector indentations upon the firing pin striking the simulated primer to effectuate the disconnection for the open position.

In an alternative embodiment, the non-projectile member is in a closed position within the cartridge casing during a first locked position between the connector and the receiver. Furthermore, the non-projectile member is in an open position during a second locked position between the connector and the receiver. Additionally, the second locked position occurs as a result of the firing pin striking the simulated primer. A top of the non-projectile member travels a distance within a predetermined range from a top of the cartridge casing in the open position without a bottom of the non-projectile member exiting the cartridge casing.

BRIEF DESCRIPTION OF THE DRAWINGS

The above-mentioned features of the present disclosure will become more apparent with reference to the following description taken in conjunction with the accompanying drawings wherein like reference numerals denote like elements and in which.

DETAILED DESCRIPTION

Figure 1A:
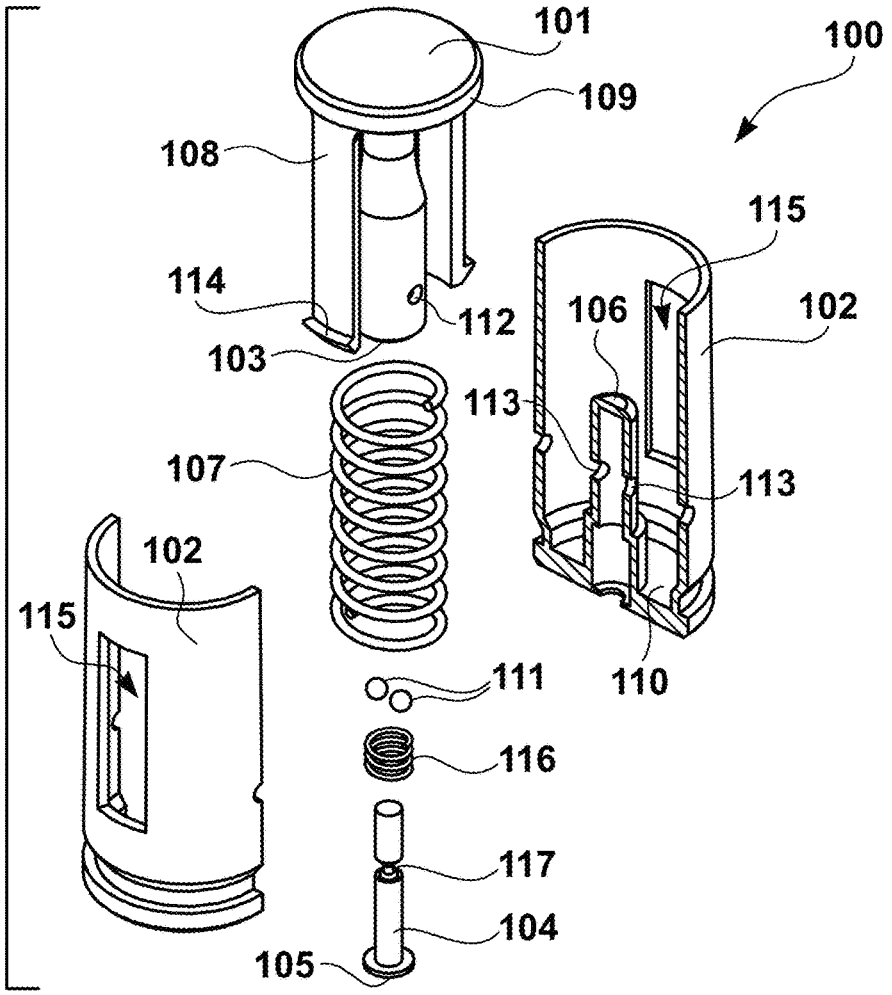
FIG. 1A illustrates a perspective view of a disassembled non-projectile cartridge.

A non-projectile cartridge is provided for use with a semi-automatic firearm. The non-projectile cartridge simulates certain features of a live cartridge, without the features of the live cartridge that pose safety concerns. Rather than emitting a projectile (e.g., a bullet) from the case through a barrel of a firearm, the non-projectile cartridge has a non-projectile member that only moves a relatively short distance (e.g., approximately one and one half millimeters) with respect to the non-projectile cartridge. The non-projectile member simulates emission of a bullet, but does not actually leave the non-projectile cartridge—it only moves a relatively short distance; such movement activates the slide of the firearm. (The distance may vary based on different calibers of the non-projectile member.) As a result, the non-projectile cartridge may be used by a firearm user in a firearm to safely perform firearm handling practice in a realistic manner without the safety hazards posed by a live, projectile-emitting cartridge.

In particular, the non-projectile cartridge may be configured to generate a substantially similar force (e.g., "kick") to that to that of a live, projectile-emitting cartridge used in the same firearm. Rather than producing an internal chemical reaction that is present within a live, projectile-emitting cartridge, the non-projectile cartridge emits a similar amount of a force via tension being removed from one or more springs; as a result, the slide of the firearm recoils with a similar amount of force. Accordingly, the non-projectile cartridge allows the firearm user to develop a similar muscle memory to the feel of using a live, projectile-emitting cartridge.

Furthermore, unlike shooting a firearm with SNAP-CAPs, the non-projectile cartridge is configured to activate the slide of the firearm so that the slide fully retracts upon emission of a last non-projectile cartridge from the magazine of a firearm, thereby providing a realistic feel for firearm handling practice. In contrast, using SNAP-CAPs within a firearm only leads to the slide returning to its unretracted position after no more SNAP-CAPs remain within the magazine.

The non-projectile cartridge may be used in firearms that hold similar sized live, projectile emitting cartridge. For instance, the non-projectile cartridge may be configured to fit a nine millimeter pistol—no specialized firearm needs to be fabricated for use with the non-projectile cartridge. Moreover, in its extended form, the length of the non-projectile cartridge may be the same, or substantially similar, length as the live, projectile-emitting cartridge. Given that the extractor of a firearm is configured to allow a user to eject a live, projectile-emitting cartridge (i.e., by manually sliding the slide) without being emitted through the barrel, the non-projectile cartridge may be ejected via the extractor.

Also, the non-projectile cartridge is particularly suitable for rapid-fire firearm handling practice (e.g., via a semi-automatic firearm), especially when cycling through multiple magazines of non-projectile cartridges. Just as in a realistic live firearm scenario, the firearm user would experience the slide in the retracted position after the last non-projectile cartridge in a magazine has been ejected, and would have to reposition the slide back into place before a subsequent non-projectile cartridge could be activated from a subsequent magazine.

Additionally, the non-projectile cartridge may be easily reset for re-use with the firearm. After being ejected, the non-projectile cartridge may be recompressed so that it may be reused in the firearm.

Figure 1B:
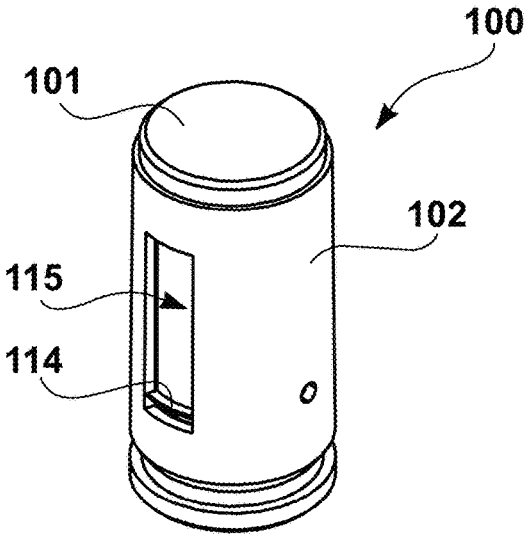
FIG. 1B illustrates the non-projectile member housed within the cartridge casing in a closed position, which is the state of the non-projectile cartridge configuration when situated in a magazine or in the chamber of the firearm, prior to being stricken by a firing pin of a firearm.
Figure 1C:
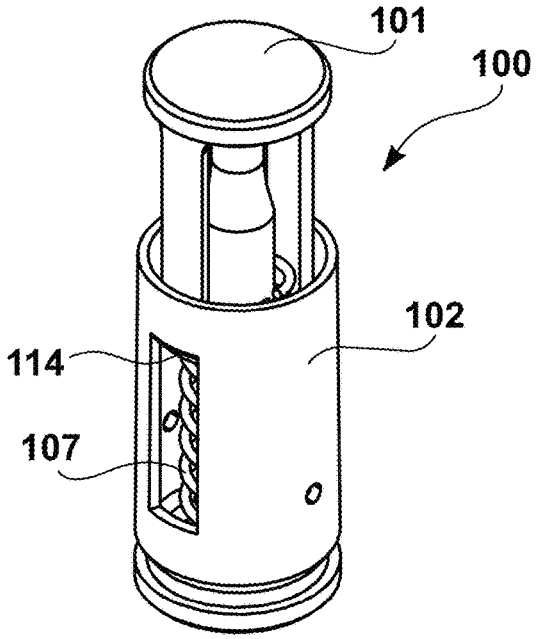
FIG. 1C illustrates the non-projectile member extending outwardly from the cartridge casing when the connector is detached from the receiver.

FIGS. 1A-1C illustrate an example of a non-projectile cartridge configuration 100. In particular, FIG. 1A illustrates a perspective view of a disassembled non-projectile cartridge 100. At the top of the non-projectile cartridge configuration 100 is situated a non-projectile member 101, which is housed within a cartridge casing 102. FIG. 1B illustrates the non-projectile member 101 housed within the cartridge casing 102 in a closed position, which is the state of the non-projectile cartridge configuration 100 when situated in a magazine or in the chamber of the firearm, prior to being stricken by a firing pin of a firearm.

Turning again to FIG. 1A, the non-projectile member 101, which is a simulated bullet that does not actually exit the barrel of a firearm, has a connector 103 that operably attaches to a receiver 106 that is operably attached to the cartridge casing 102. In essence, the non-projectile member 101 remains in the closed position, as illustrated in FIG. 1B, when the connector 103 is attached to the receiver 106. When the connector 103 is detached from the receiver 106, the non-projectile member 101 extends outwardly from the cartridge casing 102 (e.g., approximately one and one half millimeters), as illustrated in FIG. 1C.

Turning to FIG. 1A, in one embodiment, an outer spring 107 surrounds the wall 108 of the non-projectile member 101. The top of the outer spring abuts the underside of a top edge 109 of the non-projectile member 101, and abuts a bottom edge 110 of the cartridge casing 102. In the closed position, as illustrated in FIG. 1B, the top of the outer spring 107 is compressed against the underside of the top edge 109, and the bottom of the outer spring 107 is compressed against the bottom edge 110. Accordingly, the outer spring 107 is configured to exert pressure (e.g., fifteen thousand to thirty thousand pounds per square inch ("psi")) while the non-projectile cartridge configuration 100 is in the closed position for the non-projectile member 101 to be emitted from the cartridge casing 102 to be in the open position.

To keep the non-projectile cartridge configuration 100 in the closed position, the connector 103 is operably connected to the receiver 106. For example, in one embodiment, the closed position is maintained by one or more balls 111 maintaining contact between the receiver 106 and the connector 103. The one or more balls 111 may apply pressure to one or more portions of a periphery of a plunger 104 positioned within the receiver 106, while also being positioned within corresponding connector indents 112 and receiver indents 113. In other words, the connector indents 112 and the receiver indents 113 are aligned and kept in place when the one or more balls 111 protrude through both the connector indents 112 and the receiver indents 113.

Furthermore, the plunger 104 may have a bottom portion that acts as a simulated primer 105. Upon a firing pin of a firearm striking the simulated primer 105, which does not cause a chemical reaction, the plunger 104 moves upward to allow the one or more balls 111 to partially move into one or grooves 117 of the plunger 104, thereby releasing the one or more balls 111 from the connector indents 112 and the receiver indents 113. As a result, the connector 103 is disconnected from the receiver 106, and the non-projectile member 101 is permitted to at least partially exit the cartridge casing 102 to be in the open position illustrated in FIG. 1A. Alternatively, the connector 103 may move with respect to the receiver 106, but remain connected to the receiver 106.

In one embodiment, in order to restrict the distance that the non-projectile member 101 may travel out of the cartridge casing 102, the non-projectile member 101 may have a lip 114 positioned at the bottom thereof, as illustrated in FIG. 1A. Furthermore, the cartridge casing 102 may have a window 115. Upon moving upward, the lip 114 catches the top edge of the window 115, thereby preventing the non-projectile member 101 from moving beyond a predetermined distance with respect to the cartridge casing 102.

Additionally, an inner spring 116 may be utilized to help propel the plunger 104 upward to allow the balls 111 to move at least partially out of the receiver indents 113, and fully out of the connector indents 112. The inner spring 116 may be uncompressed in the closed position illustrated in FIG. 1B, and compressed in the open position illustrated in FIG. 1C.

Figure 2A:
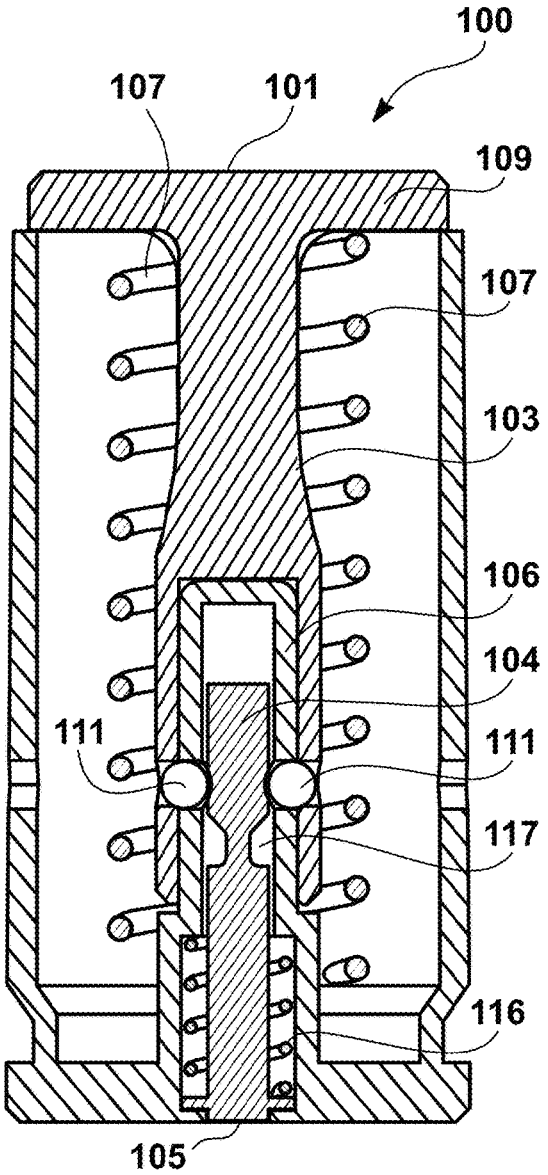
FIG. 2A illustrates the balls positioned such that they apply friction to the plunger, thereby rendering the plunger immobile.
Figure 2B:
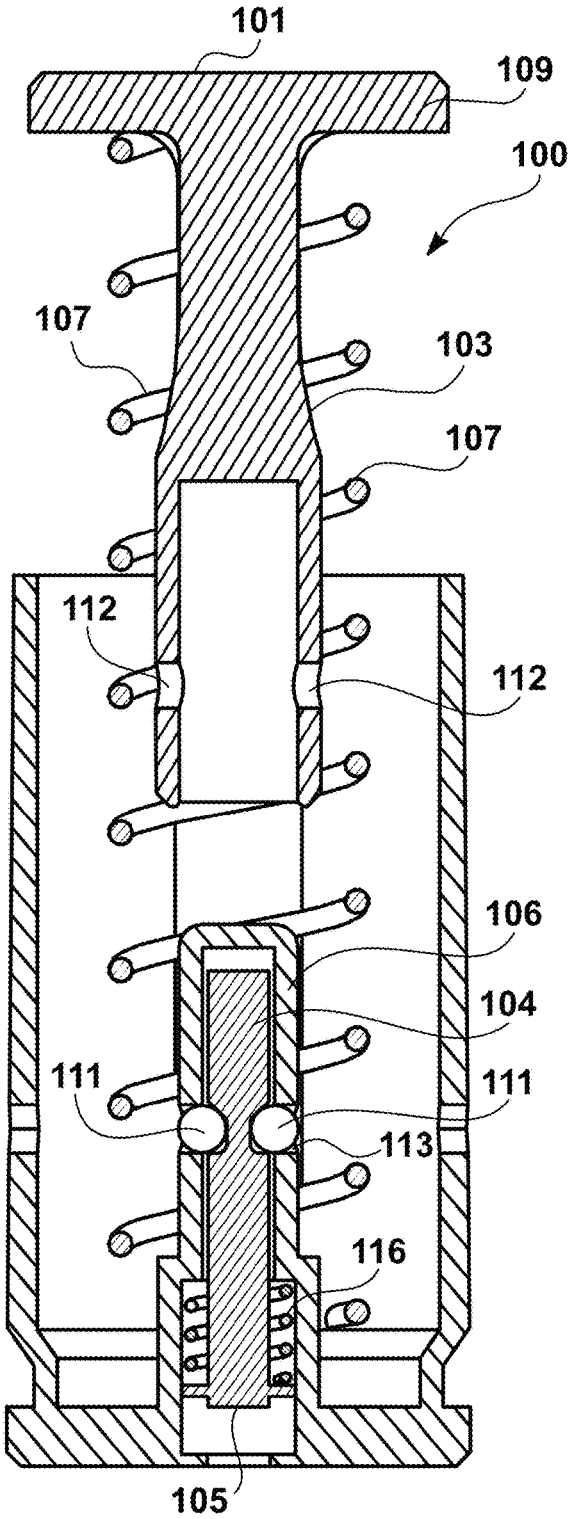
FIG. 2B illustrates the balls moving inwardly away from the connector indents upon impact between a firing pin of a firearm and the simulated primer.

FIGS. 2A and 2B illustrate a side perspective view of the closed and open positions illustrated in FIGS. 1B and 1C, respectively. In particular, FIG. 2A illustrates the balls 111 positioned such that they apply friction to the plunger 104, thereby rendering the plunger 104 immobile. Furthermore, the balls 111 are positioned in both the connector indents 112 and the receiver indents 113. As a result, the connector 103 is effectively connected to the receiver 106 to lock the non-projectile member 101 in a fixed position within the cartridge casing 102.

Upon impact between a firing pin of a firearm and the simulated primer 105, the balls 111 are able to move inwardly away from the connector indents 113, as illustrated in FIG. 2B. The balls 111 may still remain partially within the receiver indents 113, but the balls 111 move inward enough to move out of the connector indents 112. As a result, the tension in the major spring 107 is released, which allows upward pressure on the underside of the top edge 109 of the non-projectile member 101 to move the non-projectile member 101 outside of the cartridge casing 102.

Figure 3A:
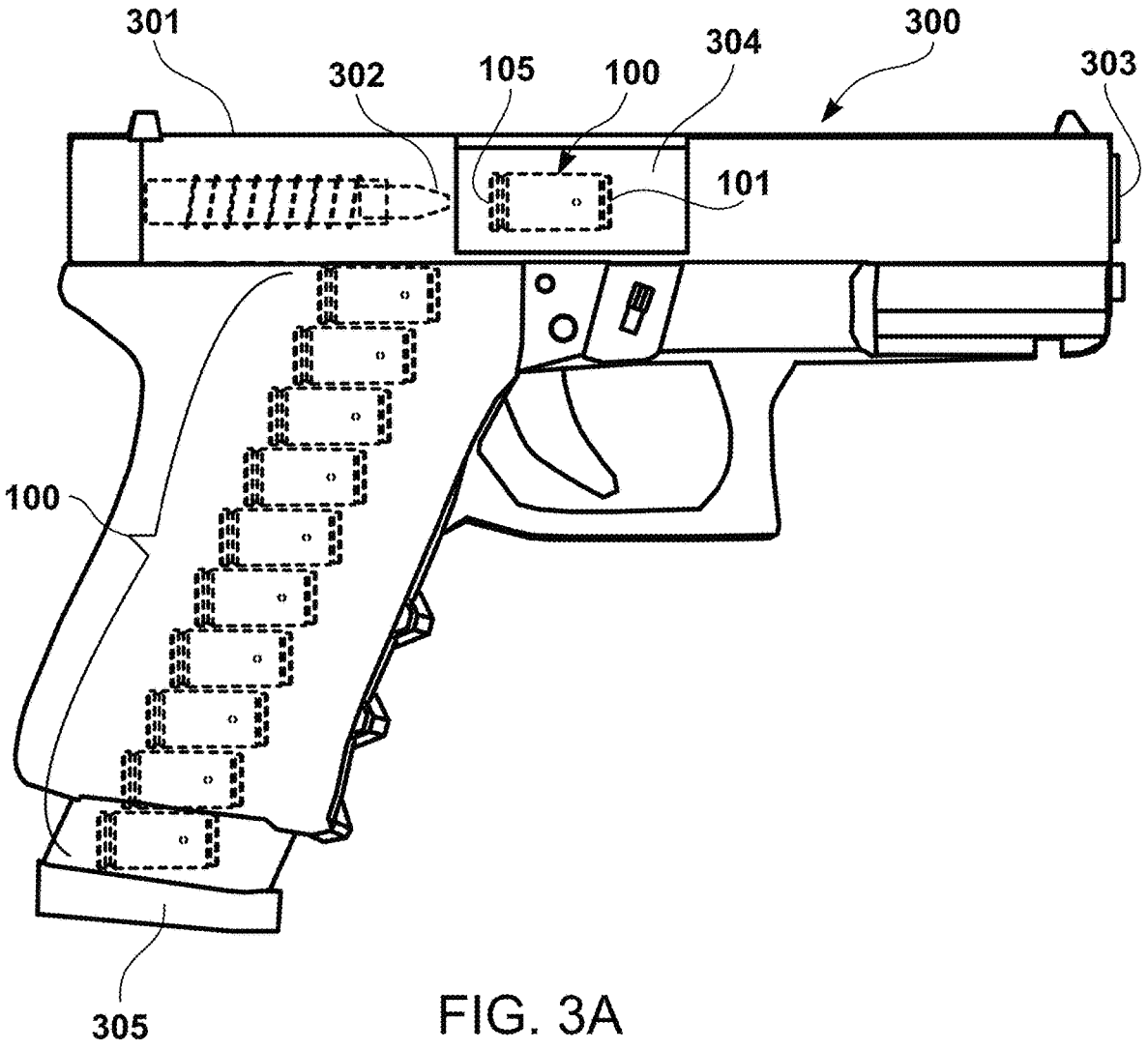
FIG. 3A illustrates the non-projectile cartridge configuration chambered within the firearm.
Figure 3B:
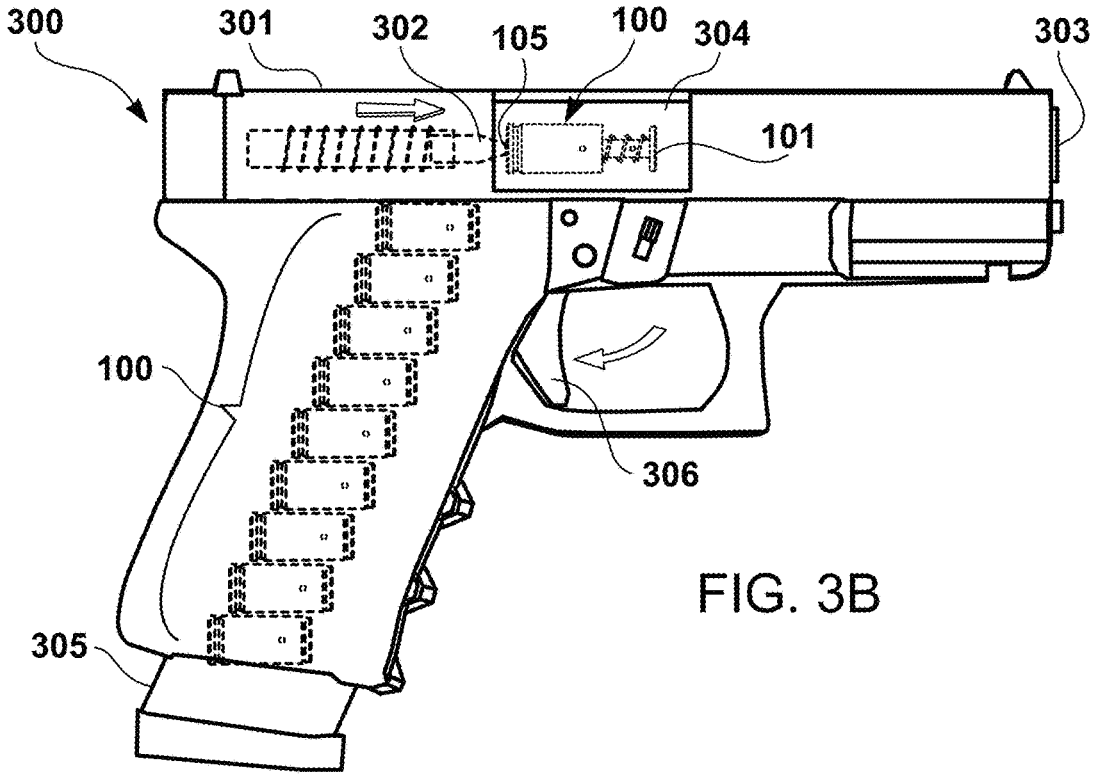
FIG. 3B illustrates a firing pin striking the simulated primer, which leads to the non-projectile member partially exiting the cartridge casing.
Figure 3C:
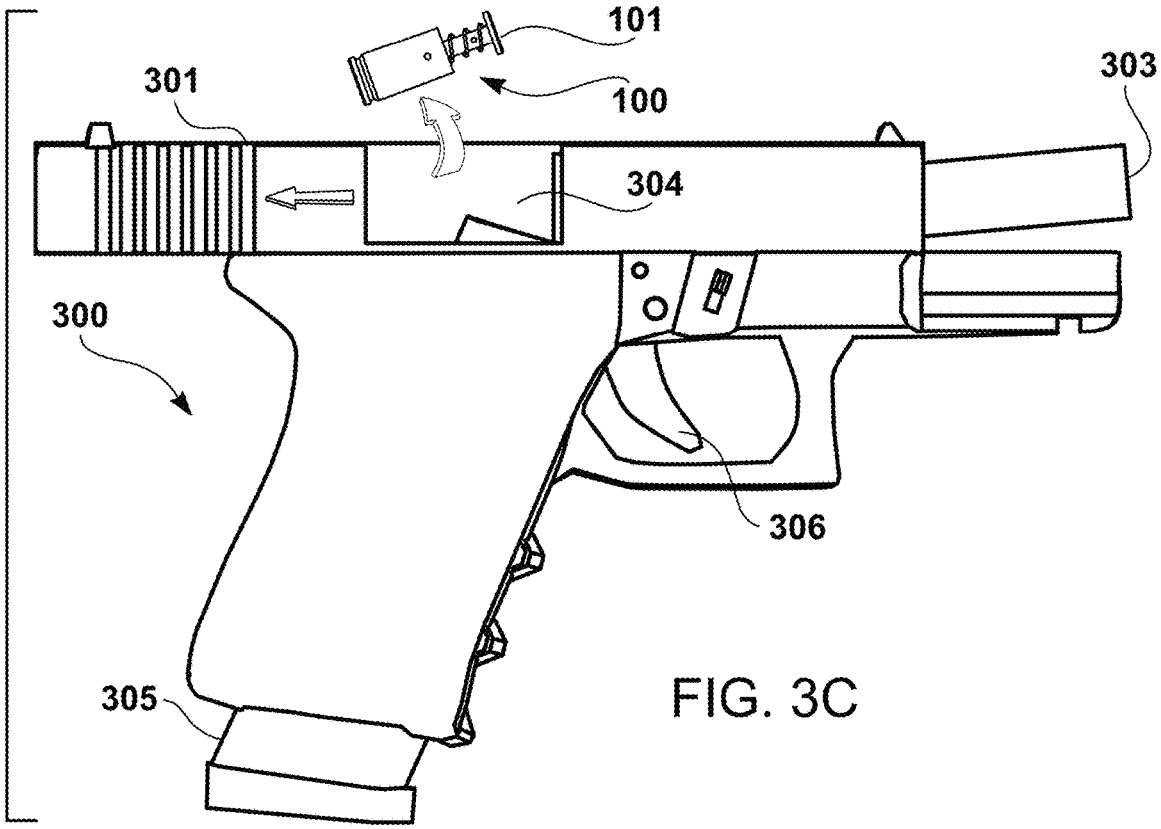
FIG. 3C illustrates the non-projectile cartridge configuration being ejected from the firearm.

FIGS. 3A-3C illustrate an example of a firearm 300 (e.g., a pistol) using the non-projectile cartridge configuration 100 illustrated in FIGS. 1A-1C. In particular, FIG. 3A illustrates the non-projectile cartridge configuration 100 chambered within the firearm 300. A magazine 305 may hold multiple non-projectile cartridges 100. Further, FIG. 3B illustrates a firing pin 302 striking the simulated primer 105 after activation of a trigger 306, which leads to the non-projectile member 101 partially exiting the cartridge casing 102. Finally, FIG. 3C illustrates the non-projectile cartridge 100 being ejected from an ejection chamber 304 of the firearm 300 (e.g., by an extractor), without exiting a barrel 303.

Figure 4A:
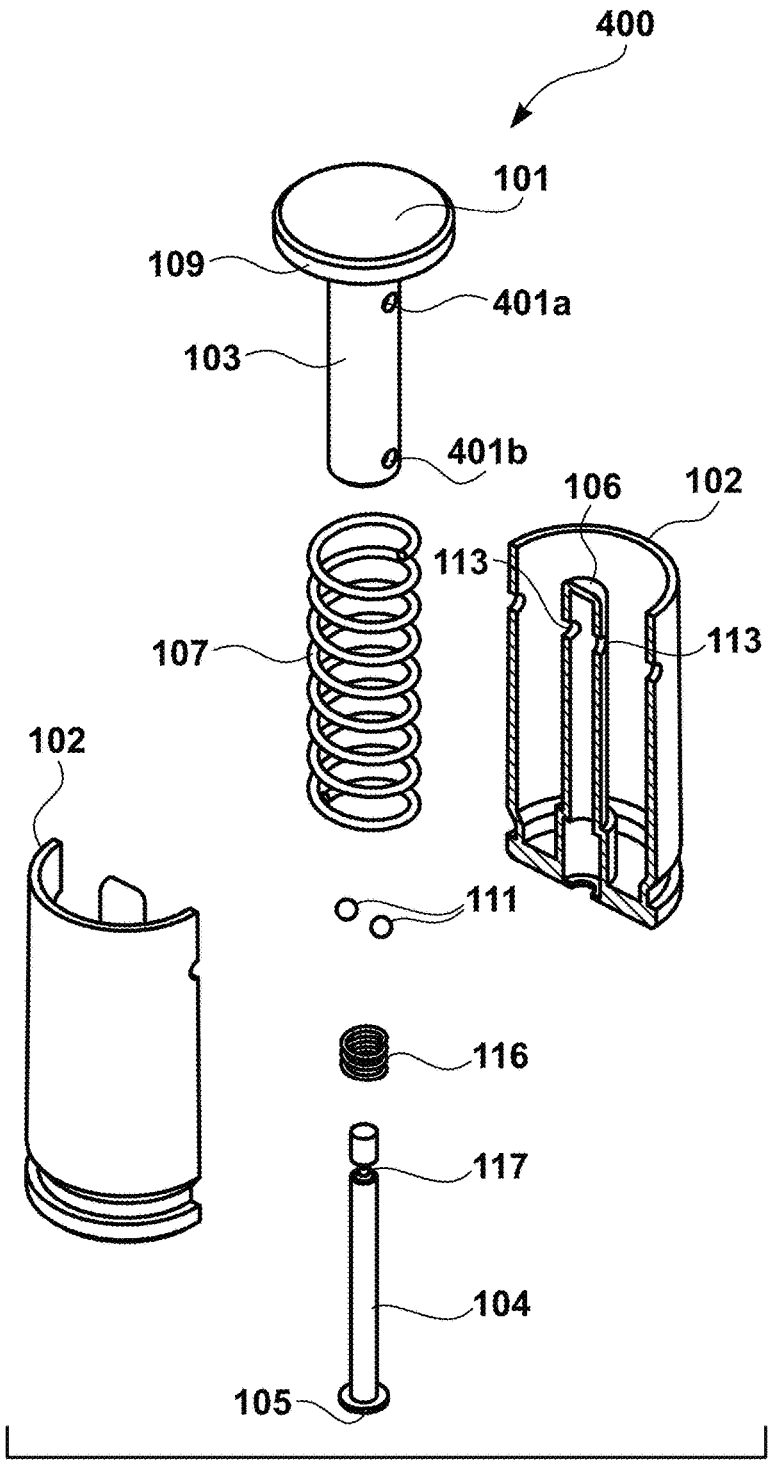
FIG. 4A illustrates a perspective view of a disassembled non-projectile cartridge.
Figure 4B:
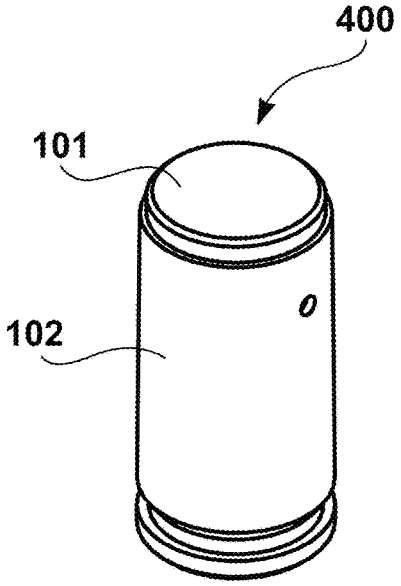
FIG. 4B illustrates the balls being situated in the top connector indents in the closed position.
Figure 4C:
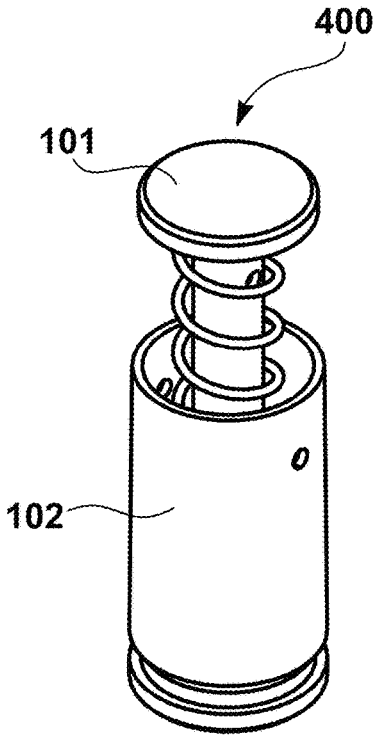
FIG. 4C illustrates the plunger moving until the bottom connector indents reach the balls to effectuate the closed position.

In an alternative embodiment, multiple indents may be used instead of the lip 114 and the window 115 illustrated in FIG. 1A. Accordingly, FIGS. 4A-4C illustrate an alternative non-projectile cartridge configuration 400. In particular, FIG. 4A illustrates a perspective view of a disassembled non-projectile cartridge 400. The connector 103 may have top connector indents 401*a* and bottom connector indents 401*b*. The balls 111 may be situated in the top connector indents 401*a* in the closed position, as illustrated in FIG. 4B. Upon the firing pin 302 striking the simulated primer 105, the plunger 106 may move until the bottom connector indents 401*b* reach the balls 111, which corresponds to the open position, as illustrated in FIG. 4C. Although the spring 107 is illustrated as being exposed in FIG. 4C in the open position, in an alternative embodiment, a covering (e.g., sleeve) may surround at least a portion of the spring 107.

Figure 5A:
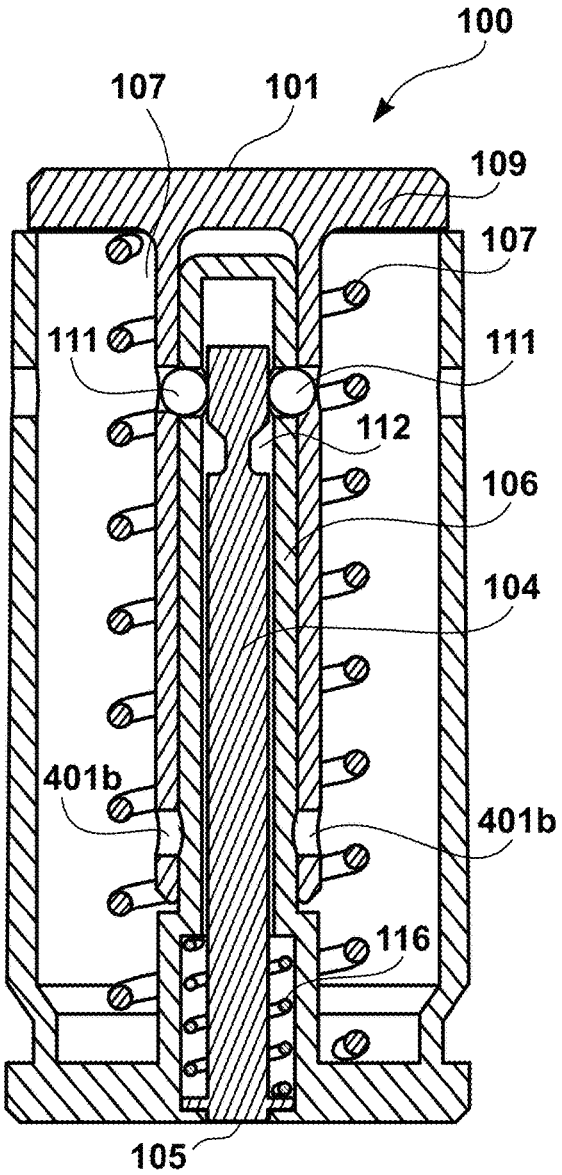
FIG. 5A illustrates the balls positioned such that they apply friction to the plunger, thereby rendering the plunger immobile.
Figure 5B:
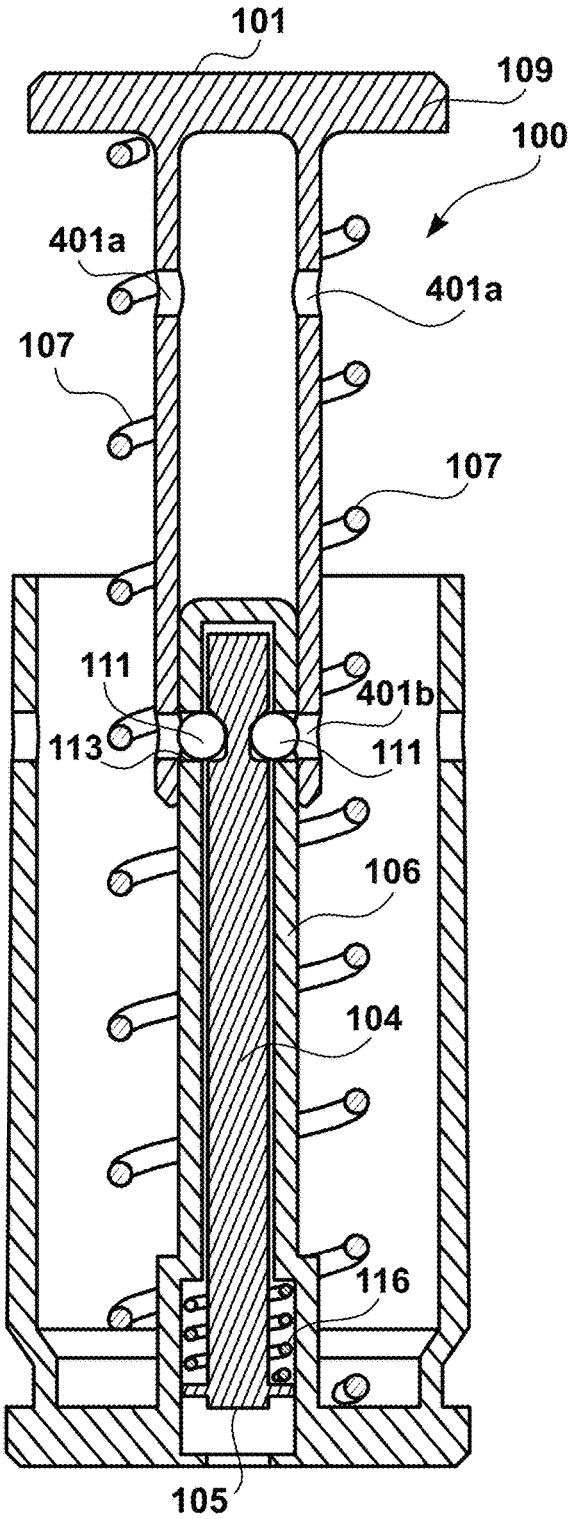
FIG. 5B illustrates the balls moving inwardly away from the top connector indents upon impact between a firing pin of a firearm and the simulated primer.

FIGS. 5A and 5B illustrate a side perspective view of the closed and open positions illustrated in FIGS. 4B and 4C, respectively. In particular, FIG. 5A illustrates the balls 111 positioned such that they apply friction to the plunger 104, thereby rendering the plunger 104 immobile. Furthermore, the balls 111 are positioned in both the top connector indents 401*a* and the receiver indents 113. As a result, the connector 103 is effectively connected to the receiver 106 to lock the non-projectile member 101 in a fixed position within the cartridge casing 102.

Upon impact between a firing pin of a firearm and the simulated primer 105, the balls 111 are able to move inwardly away from the top connector indents 401*a*, as illustrated in FIG. 5B. The balls 111 may still remain partially within the receiver indents 113, but the balls 111 move inward enough to move out of the top connector indents 401*a*. As a result, the tension in the major spring 107 is released, which allows upward pressure on the underside of the top edge 109 of the non-projectile member 101 to move the non-projectile member 101 outside of the cartridge casing 102. The non-projectile member 101 stops movement when the balls 111 fall into the bottom connector indents 401*b*.

Although various springs are described herein, and illustrated in the drawings, they are used only as examples of ejection mechanisms. Other types of ejection mechanisms (e.g., compressed air device) may be used instead. Furthermore, the balls described herein, and illustrated in the drawings, are only examples of locking/capturing mechanisms. Other types of locking/capturing mechanisms (e.g., claw, pin, clip, etc.) may be used instead.

It is understood that the apparatuses described herein may also be applied in other types of apparatuses. Those skilled in the art will appreciate that the various adaptations and modifications of the embodiments of the apparatuses described herein may be configured without departing from the scope and spirit of the present apparatuses. Therefore, it is to be understood that, within the scope of the appended claims, the present apparatuses may be practiced other than as specifically described herein.

I claim:

1. A non-projectile cartridge apparatus comprising:

a cartridge casing having a receiver positioned therein;

a simulated primer positioned at the bottom of the cartridge casing;

a rim positioned around at least a portion of a circumference of the cartridge casing, the rim configured to be gripped by an extractor of a firearm after a firing pin of the firearm strikes the simulated primer; and a non-projectile member having a connector, the non-projectile member being in a closed position within the cartridge casing during a connection between the connector and the receiver, the non-projectile member being in an open position during a disconnection between the connector and the receiver, the disconnection occurring as a result of the firing pin striking the simulated primer, wherein a top of the non-projectile member travels a distance within a predetermined range from a top of the cartridge casing in the open position without a bottom of the non-projectile member exiting the cartridge casing.

2. The non-projectile cartridge apparatus of claim 1, further comprising a spring positioned between the top of the non-projectile member and the bottom of the cartridge casing, wherein a top of the spring abuts an underside of the top of the non-projectile member, and a bottom of the spring abuts a topside of the bottom of the cartridge casing.

3. The non-projectile cartridge apparatus of claim 2, wherein the spring is compressed in the closed position.

4. The non-projectile cartridge apparatus of claim 3, further comprising:

a plunger positioned within the receiver, the plunger being moveable in a direction toward a top of the receiver;

one or more connector indentations positioned within the connector;

one or more receiver indentations positioned within the receiver; and one or more balls configured in the closed position to at least partially fill the one or more connector indentations, at least partially fill the one or more receiver indentations, and to be in contact with a least a portion of a periphery of the plunger in the closed position, wherein the one or more balls exit the one or more connector indentations upon the firing pin striking the simulated primer to effectuate the disconnection for the open position.

5. The non-projectile cartridge apparatus of claim 4, further comprising a receiver spring that propels the plunger in the direction toward the top of the receiver upon the firing pin striking the simulated primer, the receiver spring being positioned within the receiver in between a top of the receiver and the bottom of the cartridge casing.

6. The non-projectile cartridge apparatus of claim 4, wherein the non-projectile member further comprises a lip positioned along a portion of a periphery of the non-projectile member, the lip protruding through a window in the cartridge casing, the lip contacting a top edge of the window to prevent the non-projectile member from extending beyond the predetermined range.

7. The non-projectile cartridge apparatus of claim 1, wherein movement of the top of the non-projectile member activates a slide of the firearm to recoil backward, and an extractor to eject the non-projectile cartridge apparatus without the non-projectile cartridge apparatus exiting a barrel of the firearm.

8. The non-projectile cartridge apparatus of claim 7, wherein pressure exerted on the top of the non-projectile member after the ejection results in a reset to the closed position.

9. The non-projectile cartridge apparatus of claim 1, wherein the cartridge apparatus is configured for use in a semiautomatic firearm.

10. The non-projectile cartridge apparatus of claim 1, wherein the cartridge apparatus is configured for use in a fully automatic firearm.

11. The non-projectile cartridge apparatus of claim 1, wherein the cartridge apparatus is configured for use in a pistol.

12. The non-projectile cartridge apparatus of claim 1, wherein the cartridge apparatus is configured for use in a rifle.

13. A non-projectile cartridge apparatus comprising:

a cartridge casing having a receiver positioned therein;

a simulated primer positioned at the bottom of the cartridge casing;

a rim positioned around at least a portion of a circumference of the cartridge casing, the rim configured to be gripped by an extractor of a firearm after a firing pin of the firearm strikes the simulated primer; and a non-projectile member having a connector, the non-projectile member being in a closed position within the cartridge casing during a first locked position between the connector and the receiver, the non-projectile member being in an open position during a second locked position between the connector and the receiver, the second locked position occurring as a result of the firing pin striking the simulated primer, wherein a top of the non-projectile member travels a distance within a predetermined range from a top of the cartridge casing in the open position without a bottom of the non-projectile member exiting the cartridge casing.

14. The non-projectile cartridge apparatus of claim 13, further comprising a spring positioned between the top of the non-projectile member and the bottom of the cartridge casing, wherein a top of the spring abuts an underside of the top of the non-projectile member, and a bottom of the spring abuts a topside of the bottom of the cartridge casing.

15. The non-projectile cartridge apparatus of claim 14, wherein the spring is compressed in the first locked position.

16. The non-projectile cartridge apparatus of claim 15, further comprising:

a plunger positioned within the receiver, the plunger being moveable in a direction toward a top of the receiver;

one or more top connector indentations positioned within the connector;

one or more bottom connector indentations positioned within the connector;

one or more receiver indentations positioned within the receiver; and one or more balls configured in the first locked position to at least partially fill the one or more top connector indentations, at least partially fill the one or more receiver indentations, and to be in contact with a least a portion of a periphery of the plunger in the closed position, wherein the one or more balls exit the one or more top connector indentations upon the firing pin striking the simulated primer and enter the one or more bottom connector indentions to effectuate the second locked position.

17. The non-projectile cartridge apparatus of claim 16, further comprising a receiver spring that propels the plunger in the direction toward the top of the receiver upon the firing pin striking the simulated primer, the receiver spring being positioned within the receiver in between a top of the receiver and the bottom of the cartridge casing.

18. The non-projectile cartridge apparatus of claim 13, wherein movement of the top of the non-projectile member activates a slide of the firearm to recoil backward, and an extractor to eject the non-projectile cartridge apparatus without the non-projectile cartridge apparatus exiting a barrel of the firearm.

19. The non-projectile cartridge apparatus of claim 18, wherein pressure exerted on the top of the non-projectile member after the ejection results in a reset to the closed position.

20. The non-projectile cartridge apparatus of claim 13, wherein the firearm is a pistol.

* * * * *